US006302444B1

(12) United States Patent
Cobben

(10) Patent No.: US 6,302,444 B1
(45) Date of Patent: Oct. 16, 2001

(54) DOCUMENT MADE FRAUD-PROOF BY AN IRREVERSIBLY DISTORTABLE WEAKENING PATTERN

(75) Inventor: Johannes I. M. Cobben, Veldhoven (NL)

(73) Assignee: Industrial Automation Integrators (I.A.I.) B.V., Veldhoven (NL)

( * ) Notice: Subject to any disclaimer, the term of this patent is extended or adjusted under 35 U.S.C. 154(b) by 0 days.

(21) Appl. No.: 09/367,061

(22) PCT Filed: Feb. 18, 1998

(86) PCT No.: PCT/NL98/00099

§ 371 Date: Oct. 22, 1999

§ 102(e) Date: Oct. 22, 1999

(87) PCT Pub. No.: WO98/36916

PCT Pub. Date: Aug. 27, 1998

(30) Foreign Application Priority Data

Feb. 19, 1997 (NL) ..... 1005313

(51) Int. Cl.[7] ..... B42D 15/00

(52) U.S. Cl. ..... 283/72; 283/105; 283/103

(58) Field of Search ..... 283/72, 74, 75, 283/77, 67, 70, 117, 904, 102, 103, 105, 93; 428/195, 916

(56) References Cited

U.S. PATENT DOCUMENTS

| | | | | |
|---|---|---|---|---|
| 2,932,913 | | 4/1960 | Hannon . | |
| 3,417,497 | | 12/1968 | Hannon . | |
| 5,104,149 | * | 4/1992 | Hoppe | 283/94 |
| 5,351,993 | * | 10/1994 | Wright et al. | 283/105 X |
| 5,944,355 | * | 8/1999 | Rich et al. | 283/105 X |

FOREIGN PATENT DOCUMENTS

| | | |
|---|---|---|
| 0626275 | 11/1994 | (EP) . |
| 2626392 | 7/1989 | (FR) . |

* cited by examiner

*Primary Examiner*—Willmon Fridie, Jr.
(74) *Attorney, Agent, or Firm*—Banner & Witcoff, Ltd.

(57) ABSTRACT

The invention relates to a fraud-proof document comprising a carrier and at least one marking arranged on the carrier, wherein at least a part of the surface of the marking or along at least a part of the periphery of the marking a weakening pattern is arranged in the carrier which, when detached, results in a permanent an easily visible distortion of the pattern. When removing the glued-on passport photo or foil a forger will irrevocably distort the weakening pattern, this such that the regularity is permanently and visibly disturbed so that it is easy to ascertain that the document in question has been subjected to an attempted fraud.

25 Claims, 3 Drawing Sheets

DOCUMENT MADE FRAUD-PROOF BY AN IRREVERSIBLY DISTORTABLE WEAKENING PATTERN

BACKGROUND OF THE INVENTION

The invention relates to a fraud-proof document comprising a carrier and at least one marking arranged on said carrier.

Such documents are generally known, for instance in the form of passports, driving licences, credit cards and the like.

The personalized markings can be formed by a passport photograph arranged on the carrier or a marking arranged on the carrier by means of ink, for instance a signature or a name printed on the carrier.

It will be apparent that when such a document falls into the hands of a forger, the forger will attempt to provide the document with different personalized markings, for instance with a different passport photograph and a different name, and so son. The forger will herein have to gain access to the markings originally applied to the carrier in order to remove or change them.

EP-A-0 626 275 discloses a fraud-proof document, comprising a carrier, provided with an aperture into which a passport photograph has been inserted. This leads to a weakening between the passport photograph and the carrier. To make forging difficult, the passport photograph and the aperture are cut by the same tool with a knurled edge so that the passport photograph fits exactly in the aperture and any attempt to replace the passport photograph will be immediately apparent. To fix the passport photograph in the carrier, a lamination is applied.

However this prior art document requires the tool to be present at the location where the personalisation, that is inter alia the unification with the passport photograph takes place.

FR-A-2 626 392 discloses a fraud-proof document wherein a passport photograph is applied onto the document. After this application embossing of the thus obtained unit takes place, leading to a possible weakening of the unit, but without removal of material.

The aim of the invention is to provide such a document wherein the weakening pattern can be applied before personalisation, leading to substantial logistic economies.

This object is achieved by providing a fraud-proof document, comprising a carrier and at least one marking arranged on said carrier, wherein at least a part of the surface of the carrier on which the marking is applied or along the periphery of the surface of the carrier on which the marking is applied a weakening pattern is provided by removal of carrier material, wherein the weakening pattern is arranged in the carrier only and, when detached, results in a permanent and easily visible distorsion of the pattern.

These features allow the document to be provided with the weakening before personalisation.

When removing the glued-on passport photograph or foil the forger will irrevocably distort the weakening pattern, this such that the regularity is permanently and visibly disturbed so that it is easy to ascertain that the document in question has been subjected to an attempted fraud.

According to a preferred embodiment the weakening pattern comprises a linear weakening arranged in the material of the document and extending along at least one line.

This weakening will tear when violated, so that a visible and irreversible distortion occurs.

According to a second embodiment the weakening lines extend in a regular structure so that distortions of the structure are immediately visible.

In accordance with the now provided, most effective embodiment, the weakening extends in a rectangular or dovetail-shaped toothing.

According to another preferred embodiment the weakening extends in spiral form.

According to yet another preferred embodiment the weakening extends at least partly in radial lines.

According to an attractive embodiment the linear weakening is formed at least partly by a perforation.

A preferred embodiment relates to such a document, wherein a transparent foil is adhered to the carrier, wherein when carrier and foil are separated the weakening pattern remains adhered partly to the foil and partly to the carrier.

Such a measure finds application inter alia in the Dutch passport. In order to remove a marking applied to such a carrier, the forger will first have to remove the foil. Because in accordance with said embodiment of the invention the weakening pattern remains adhered partly to the foil when the foil is removed, the distortion of the pattern will be permanently visible after the marking has been removed and replaced by a falsified marking and the foil returned to its position.

According to another preferred embodiment the visibility of the weakening pattern is accentuated by measures in the printing which result in greater contrast differences or colour differences. This makes the distortion of the pattern even more apparent.

According to yet another preferred embodiment the document imprinted and provided with at least one colour transition at the position of the weakening pattern. This makes distortion of the zone even more apparent.

According to yet another preferred embodiment the weakening is arranged by a laser spot.

BRIEF DESCRIPTION OF THE DRAWINGS

The present invention will be elucidated hereinbelow with reference to the annexed figures, in which.

DETAILED DESCRIPTION OF THE INVENTION

Figure 1:
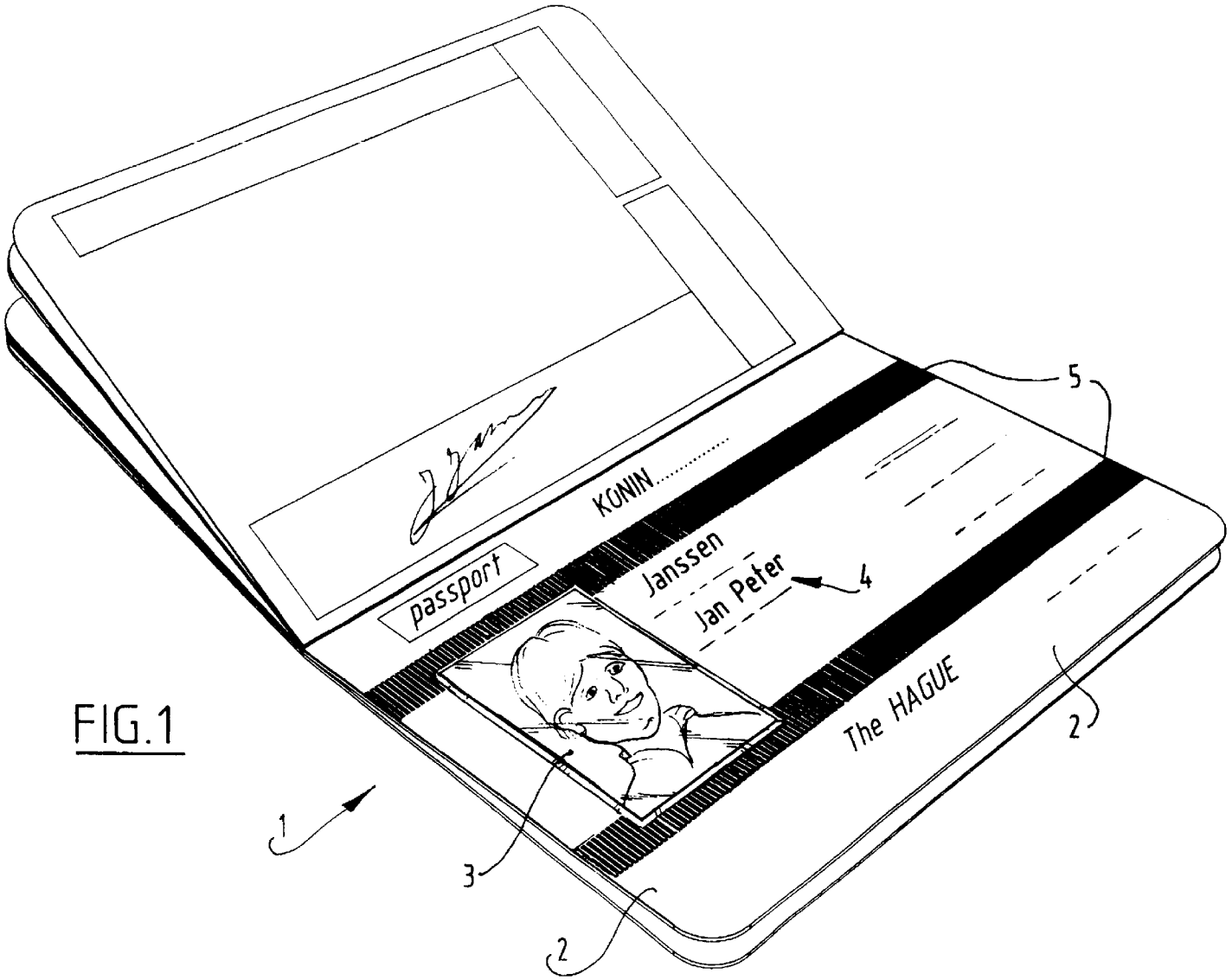
FIG. 1 shows a perspective view of a passport according to the present invention.

FIG. 1 shows a passport 1 provided with a personalized page 2. Personalized markings in the form of a passport photo 3 and a name 4 are arranged on the personalized page. The personalized page 2 is manufactured from a strong carrier material, usually paper, in which weakening pattern 5 has already been arranged. After the page is provided with the personalized markings in the form of passport photo 3, name 4 and possible further designations, the page is provided with a self-adhesive foil which during application develops a great adhesive force by means of heating.

In order to complicate removal and changing of the personalized markings two weakening patterns 5 are arranged in the carrier. These extend parallel to the edges of the passport photo over the whole width of the page and are partially covered by the glued-on passport photo. The patterns are formed by perforated lines in the form of a toothing which are readily visible to the eye.

When a forger thus attempts to gain access to the personalized markings he will inevitably damage the weakening pattern when removing the foil, because parts of this pattern will adhere to the foil and other parts will remain behind on the carrier. All markings on this page are protected by the extent of the patterns 5. An additional protection takes place round passport photo 3. This is in any case glued partly onto the weakening pattern, whereby the pattern is again damaged locally when the passport photo is removed.

Due to the fineness of the pattern and the damage thereto it is no longer possible to re-place the elements of the pattern with any accuracy at their original position, so that the distortion is permanently and conspicuously visible.

It will be apparent that this results in a high degree of security against fraud.

Figures 2, 3:
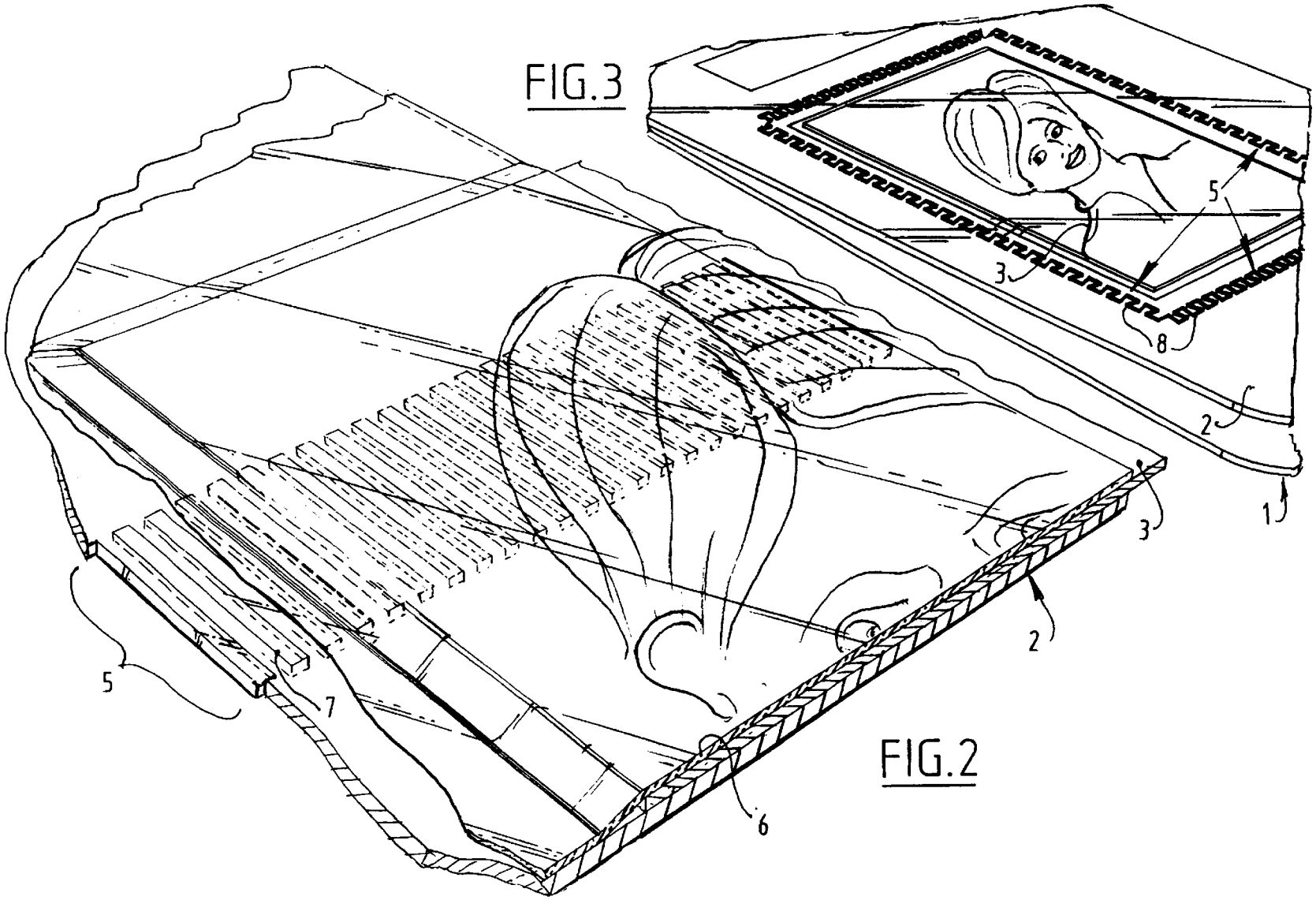
FIG. 2 shows a detail view of a variant of the passport illustrated in FIG. 1.
FIG. 3 is a perspective view of an alternative embodiment of a passport according to the invention.

Various aspects are shown in more detail in FIG. 2. The foil 6 is moreover shown herein. The perforated weakening lines extend through the whole thickness of the carrier material. In order to make the pattern easily visible, carrier material must be removed over a well visible line width. Such an operation is performed in excellent manner by means of a laser spot. So as to be readily visible the weakening pattern 5 can be about 10 mm wide. The lines within this pattern have a well visible line width in the order of 0.7 mm. Pattern parts left in place between lines such as teeth, dovetails and spiral parts have the same width up to a small number of times the line width. This enhances the visibility of the regularity in the pattern.

It will be apparent that it is not possible to restore such a pattern, once disturbed, to its original state.

It will also be apparent that applying a suitable colour on the field of the weakening pattern can visually emphasize a possible disruption of the pattern, whereby the chance of detection is increased. It is further possible to choose an ink which displays a colour change with laser treatment and in this way enhances the visibility of the pattern.

The present embodiment relates to a perforation 7. It will be apparent that it is not per se necessary for the linear weakenings extending as a toothing over the whole weakening pattern to be formed by a perforation; it is equally possible for these to be formed by a groove. Then also they are preferably arranged with a laser spot.

Instead of the shown pattern in the form of a toothing it is also possible to use other patterns, for instance a dovetail pattern as shown in FIG. 3.

The embodiment shown in FIG. 3 is distinguished from the embodiments shown in FIGS. 1 and 2 in that the weakening pattern extends round passport photo 3, in the case of attempts to remove the foil, the weakening pattern thus provides protection against incursions from all sides.

The patterns in the form of a dovetail and toothing reveal much damage when foil is separated from carrier material because parts of the foil remain adhered while other parts remain connected to the carrier. This has to do with the surface area of the diverse pattern parts, the adhesive force of the foil and the strength of the remaining connections to the rest of the carrier.

The spiral-shaped pattern is particularly suitable for placing at the corner points of passport photos to be glued in. Because it is connected partly to the photo and partly to the carrier it will have to be damaged when the photo is removed. When the spiral is damaged large conspicuous holes are found to appear.

Figure 4:
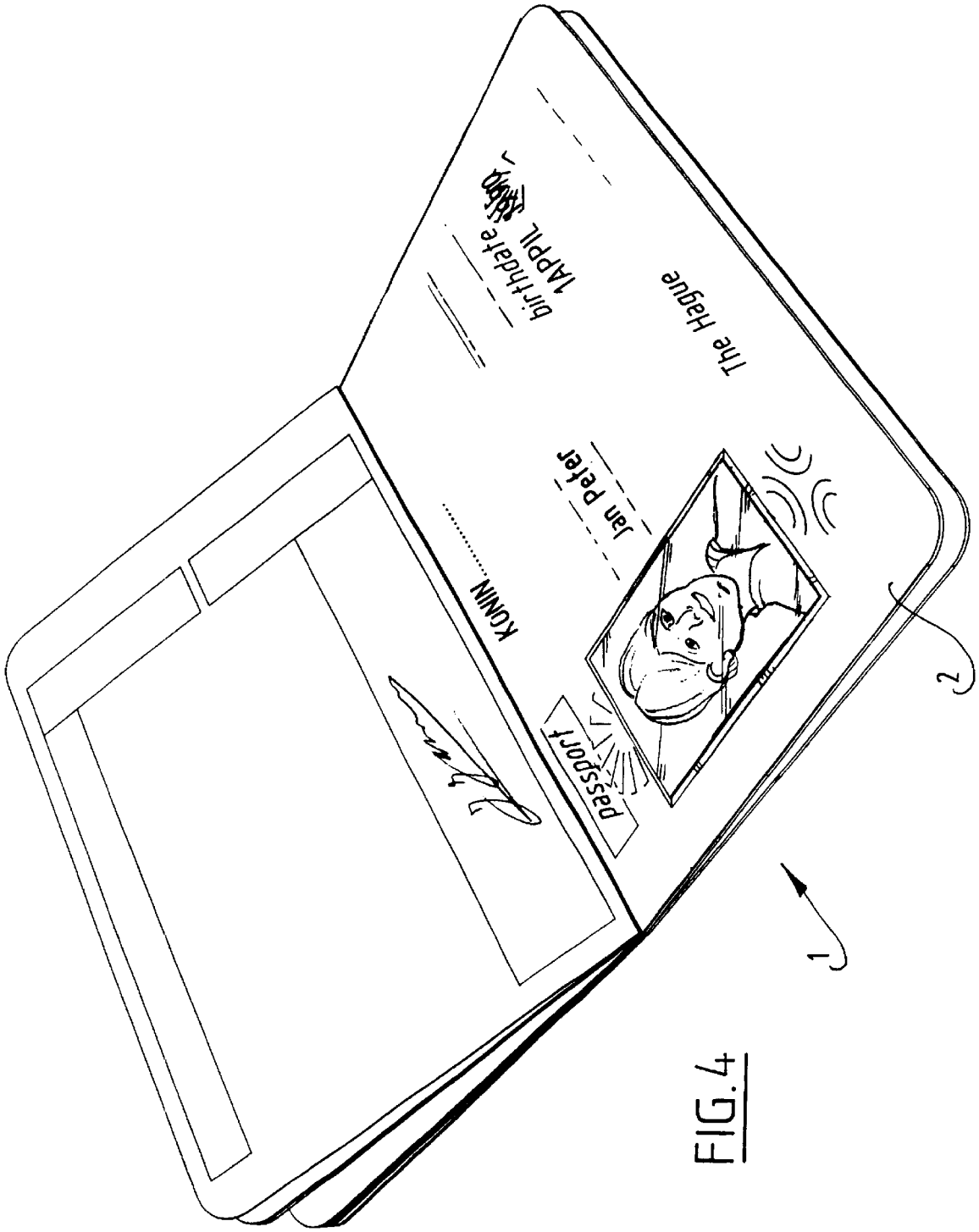
FIG. 4 is a perspective view of another embodiment.

In the passport shown in FIG. 4 not only is the vicinity of passport photo 3 provided with weakenings according to the invention but also the date of birth 9. This is in any case also a feature that is susceptible to forgery.

Passport photo 3 is protected by a weakening pattern 10 at the bottom, which is formed by three pairs of concentric circular arcs. These thus form a regularly ordered pattern, wherein a disturbance of the pattern is immediately apparent. Conversely, a pattern 11 is arranged at the top of the passport which is formed by radial weakening lines which extend through a semi-circular arc and which are provided on their distal end with tangential portions. Here too a regular pattern is formed which immediately shows when tampering has occurred, for instance through an attempt to remove the passport photo.

This also applies for the date of birth 9. This is likewise printed on a weakening pattern 11.

Finally, it is pointed out that it is possible to print the weakening pattern, as otherwise already shown in the case of the date of birth. This is also possible for instance in the vicinity of the passport photo so as to make attempted tampering even more easily apparent.

It is otherwise pointed out that the invention can also be applied when there is no laminated transparent foil. In order in that case to prevent damage to the pattern during normal use, the use of a transparent protective cover is to be recommended.

It will also be apparent that many other weakening patterns can be applied. Style requirements may also influence the design.

What is claimed is:

1. A fraud-proof document comprising a carrier and at least one detachable marking arranged on said carrier, wherein a part of the surface of the carrier to which the marking is applied is weakened with a pattern comprising a groove or a series of perforations, wherein the weakened pattern is arranged in the carrier only whereby when said markings are detached from said carrier the result is a permanent and easily visible distortion of the pattern.

2. Document according to claim 1, characterized in that the marking (3, 4) is a personalized marking (3), which is adhered to the carrier.

3. Document according to claim 1, characterized in that the weakened pattern (5, 8) is linear and extends into a regular structure so that distortions of the structure are immediately visible.

4. Document according to claim 3, characterized in that the weakened lines (5, 8) extend in a rectangular, dovetail-shaped toothing, or spiral form.

5. Document according to claim 3, characterized in that the weakened lines (5, 8) extend at least partly in radial lines, and also extend in substantially tangential lines connected to the radial lines.

6. Document according to claim 3, characterized in that the linear weakening (5, 8) is formed at least partly by perforations.

7. Document according to claim 3, characterized in that the linear weakening (5, 8) is formed at least partly by a groove.

8. Document according to claim 1, characterized in that more than one marking (3, 4) is arranged on the carrier (2) and that the markings (3, 4) in part overlap the weakening pattern (5).

9. Document according to claim 1, characterized in that printing at the position of the weakened pattern enhances the visibility of the pattern.

10. Document according to claim 1, characterized in that use is made for printing at the position of the weakened pattern of ink which reacts to laser action with a color change.

11. Document according to claim 2, characterized in that the weakened pattern (5, 8) comprises a linear weakening, and that the weakening lines (5, 8) extend in a regular form so that distortions of the structure are immediately visible.

12. Document according to claim 4, characterized in that the linear weakened pattern (5, 8) is formed at least partly by perforations.

13. Document according to claim 5, characterized in that the linear weakened pattern (5, 8) is formed at least partly by perforations.

14. Document according to claim 4, characterized in that the linear weakening (5, 8) is formed at least partly by a groove.

15. Document according to claim 5, characterized in that the linear weakening (5, 8) is formed at least partly by a groove.

16. Document according to claim 3, characterized in that a transparent foil (6) is adhered to the carrier (2), wherein when carrier and foil are separated the weakening pattern remains adhered partly to the foil (6) and partly to the carrier (2).

17. Document according to claim 6, characterized in that a transparent foil (6) is adhered to the carrier (2), wherein when carrier and foil are separated the weakening pattern remains adhered partly to the foil (6) and partly to the carrier (2).

18. Document according to claim 3, characterized in that use is made for printing at the position of the weakened pattern of ink which reacts to laser action with a color change.

19. Document according to claim 11, characterized in that use is made for printing at the position of the weakened pattern of ink which reacts to laser action with a color change.

20. A fraud-proof document comprising a carrier and at least one marking arranged on said carrier, wherein a part of the surface of the carrier on which the marking is applied is weakened with a pattern comprising a groove or a series of perforations, wherein the weakened pattern is arranged in the carrier only whereby when said markings are detached from said carrier the result is a permanent and easily visible distortion of the pattern, said document including a transparent foil adhered to the carrier, wherein when said carrier and foil are separated the weakened pattern remains adhered partly to the foil and partly to the carrier.

21. A document according to claim 1, wherein the weakened pattern is formed at least partly by perforations.

22. A document according to claim 1, characterized in that use is made for printing at the position of the weakened pattern of ink which changes color when subjected to laser light.

23. A document according to claim 20, characterized in that use is made for printing at the position of the weakened pattern of ink which changes color when subjected to laser light.

24. A document according to claim 1, wherein the weakened area is formed at least partly by a groove.

25. A document according to claim 20, wherein the weakened area is formed at least partly by a groove.

* * * * *